US009992832B2

(12) United States Patent
Weiss et al.

(10) Patent No.: US 9,992,832 B2
(45) Date of Patent: Jun. 5, 2018

(54) LIGHT BRIGHTNESS AND COLOR TEMPERATURE CONTROL UNIT

(71) Applicant: AFX Inc., Waukegan, IL (US)

(72) Inventors: Gregory Weiss, Palatine, IL (US); Bill Solomon, Highland Park, IL (US)

(73) Assignee: AFX Inc., Waukegan, IL (US)

( * ) Notice: Subject to any disclaimer, the term of this patent is extended or adjusted under 35 U.S.C. 154(b) by 0 days. days.

(21) Appl. No.: 15/587,453

(22) Filed: May 5, 2017

(65) Prior Publication Data

US 2017/0325298 A1 Nov. 9, 2017

Related U.S. Application Data

(60) Provisional application No. 62/332,542, filed on May 6, 2016.

(51) Int. Cl.
*H05B 33/00* (2006.01)
*H05B 33/08* (2006.01)

(52) U.S. Cl.
CPC ..... *H05B 33/083* (2013.01); *H05B 33/0854* (2013.01); *H05B 33/0872* (2013.01)

(58) Field of Classification Search
CPC ..... H05B 33/0845; H05B 33/0809; H05B 33/089; H05B 33/0815; H05B 33/0851; H05B 33/086; H05B 37/0272; H05B 37/0254; H05B 37/029; H05B 33/0803; H05B 37/02; H05B 37/0263; H05B 33/0857; H05B 37/024
See application file for complete search history.

(56) References Cited

U.S. PATENT DOCUMENTS

2017/0231058 A1* 8/2017 Sadwick ..... H05B 33/0896

* cited by examiner

*Primary Examiner* — Monica C King

(57) ABSTRACT

A light control unit that includes a housing sized and shaped as a standard electrical dimmer switch that can reside in an a standard electrical Handy Box and at least one integrated circuit that comprises a brightness dimming control adapted to reduce and increase brightness of one or more light sources, for example a series of light sources, electronically connected to the at least one integrated circuit and a correlated color temperature (CCT) control adapted to change color temperature of light emitted from the one or more light sources.

9 Claims, 10 Drawing Sheets

LIGHT BRIGHTNESS AND COLOR TEMPERATURE CONTROL UNIT

RELATED APPLICATION

This application claims the benefit of priority under 35 USC 119(e) of U.S. Provisional Patent Application No. 62/332,542, filed on May 6, 2016, the contents of which are incorporated herein by reference in their entirety.

BACKGROUND OF THE INVENTION

The present invention, in some embodiments thereof, relates to a light controller and, more specifically, but not exclusively, to a light controller having multiple dimming controls.

The fluorescent lamp dimming switches have been on the market for many years. Because of the new prominence of light emitting diodes (LED) lighting into the market, a need for LED lighting dimming controllers has emerged. LEDs are ideal light engines for dimming because their efficiency is maintained and even improved over a wide range of light outputs and dimming increases the operating life time LEDs.

Typical dimming controllers used in fluorescent lighting are installed with a 2-wire high-low control system, also referred to as current sink topology. Dimming controllers installed in this fashion are incompatible with the LED drivers that operates with a current source topology. Accordingly, in-wall dimming switches used for controlling fluorescent light cannot be used to control dimming LED lighting drivers with LED light engines. Further, where dimming controllers are wired to control dimming of LED light engines, fluorescent light engines cannot be dimmed using the same dimming controllers.

SUMMARY OF THE INVENTION

According to an aspect of some embodiments of the present invention there is provided a light control unit that comprises a housing sized and shaped as a standard electrical Handy Box and at least one integrated circuit that comprises a brightness dimming control adapted to reduce brightness of at least one light source electronically connected to the at least one integrated circuit and a correlated color temperature (CCT) control adapted to change color temperature of light emitted from the at least one light source.

Optionally, the at least one light source is a series of light sources.

Optionally, the at least one integrated circuit further comprises a power switch.

Optionally, the at least one integrated circuit is a single board IC.

Optionally, the at least one integrated circuit is electronically connected to the at least one light source via an alternating current (AC)/direct current (DC) driver.

Optionally, the at least one integrated circuit is electronically connected to a power source via an alternating current (AC)/direct current (DC) driver.

Optionally, the at least one light source is an array of a plurality of light emitting diodes (LEDs) with different CCTs.

More optionally, the plurality of LEDs are angled in relation to a longitudinal axis.

More optionally, at least one of the brightness dimming control and the correlated color temperature (CCT) control is controlled by an output of a motion sensor.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings and images. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
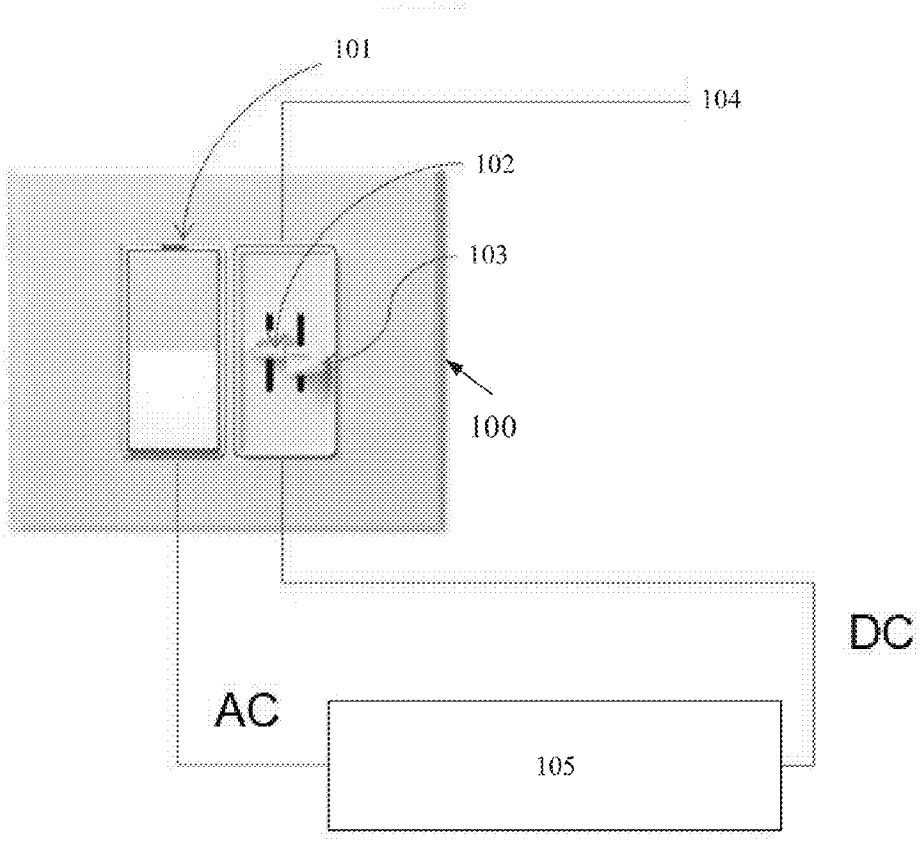
FIG. 1 is a schematic illustration of an exemplary wall mounted light control unit that includes an AC power switch and two DC dimmer switches for controlling one or more light sources, according to some embodiments of the present invention.

The present invention, in some embodiments thereof, relates to a light controller and, more specifically, but not exclusively, to a light controller having multiple dimming controls.

According to some embodiments of the present invention, there is provided a light controller unit, optionally a single integrated circuit (IC), that integrates a light dimming control for controlling a dimming range of one or more light source(s) such as LED array, optionally along a preset step, and correlated color temperature (CCT) control for controlling the color temperature of light emitted from the light source, for example adapted to control a change in a range from 2700K to 4000K, optionally along with presets at 2700K, 3000K, 3500K, and 4000K. Optionally, also a power for the light source is integrated. The light controller unit is sized and shaped to be in or to be incorporated into a standard electrical Handy Box adapted to mount on the surface of a wall as a standard wall dimmer switch (e.g. Standard rectangular box, Square box, Round or octagonal box, and Ceiling box). The light controller unit may be used in an in-wall installation or as a standalone unit.

Optionally, the light controller unit is connected to an AC/DC driver is sized and shaped to be structurally separated from the light controller unit. For example, a wall mounted housing such as a standard electrical Handy Box includes the IC of the light controller unit does not contain the driver.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing.

Computer readable program instructions described herein can be downloaded to respective computing/processing devices from a computer readable storage medium or to an external computer or external storage device via a network, for example, the Internet, a local area network, a wide area network and/or a wireless network.

The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

According to some embodiments of the present invention, there is provided a light control unit that includes a housing sized and shaped as a standard electrical Handy Box and integrated circuit(s) that comprise a brightness dimming control adapted to reduce and increase brightness of light emitted from light source(s) electronically connected to the integrated circuit(s) and a correlated color temperature (CCT) control adapted to change color temperature of light emitted from the at least one light source. The controls are optionally direct current (DC) output controls.

Optionally, the integrated circuit(s) further include an alternating current (AC) power switch. The light control unit is optionally connected to the light sources via one or more AC/DC drivers which are external to the housing. The housing is optionally adapted to be wall mounted and may include a power switch.

For example, reference is now made to FIG. 1, which is a schematic illustration of an exemplary wall mounted light control unit 100 that includes an AC power switch 101 and two DC dimmer switches 102, 103 for controlling one or more light sources, according to some embodiments of the present invention. One of the direct DC switches 102 is a light dimming control that functions as a light dimmer for lowering brightness of the light of the light source(s) and another 103 is a color temperature control adapted to control the CCT of the light source(s). The two are optionally placed in a common frame 104. In these embodiments, the AC power 101 switch and two DC dimmer switches 102, 103 are separately wired to an AC/DC driver 105 for separating the AC powering from the DC control signals. The AC/DC driver 105 is electronically connected to one or more light sources (not shown). The light sources may be a light emitting diode (LED) array and/or any other light emitting source.

Figure 2:
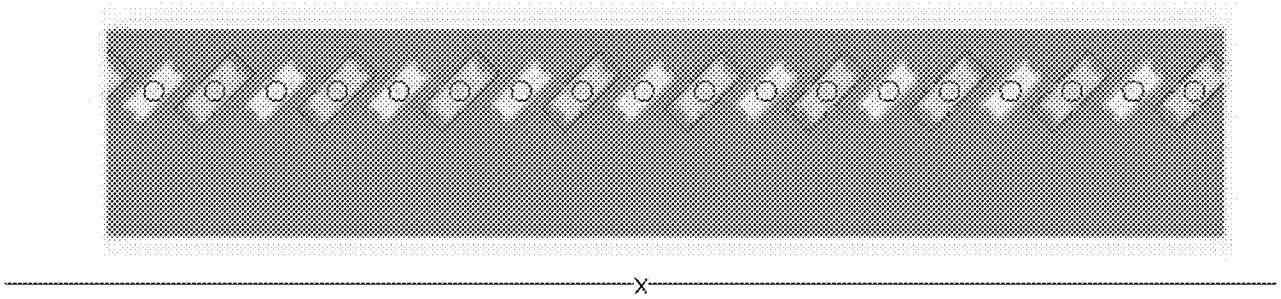
FIG. 2 is a schematic illustration of an exemplary LED array having a plurality of LEDs with different correlated color temperatures which are inclined in relation to a latitudinal axis, according to some embodiments of the present invention.

According to some embodiments of the present invention, the AC/DC driver 105 is connected to a LED array having one or more lines of different correlated color temperatures (CCTs) of LEDs. LEDs of one CCT type and LEDs of another CCT type are optionally placed interchangeably along an axis (this may apply respectively also when more than two different types of LEDS are used). The LED are optionally angled in relation to an axis X, for instance having about 40 degree angle positioning as depicted in FIG. 2. Such an array with mixed CCTs of LEDS smooths light output and reduces hot spots by decreasing distance different CCT type of LEDs. This also allows minimizing the total number of LEDs needed to create a uniform illumination in a defined light intensity.

Figure 3A:
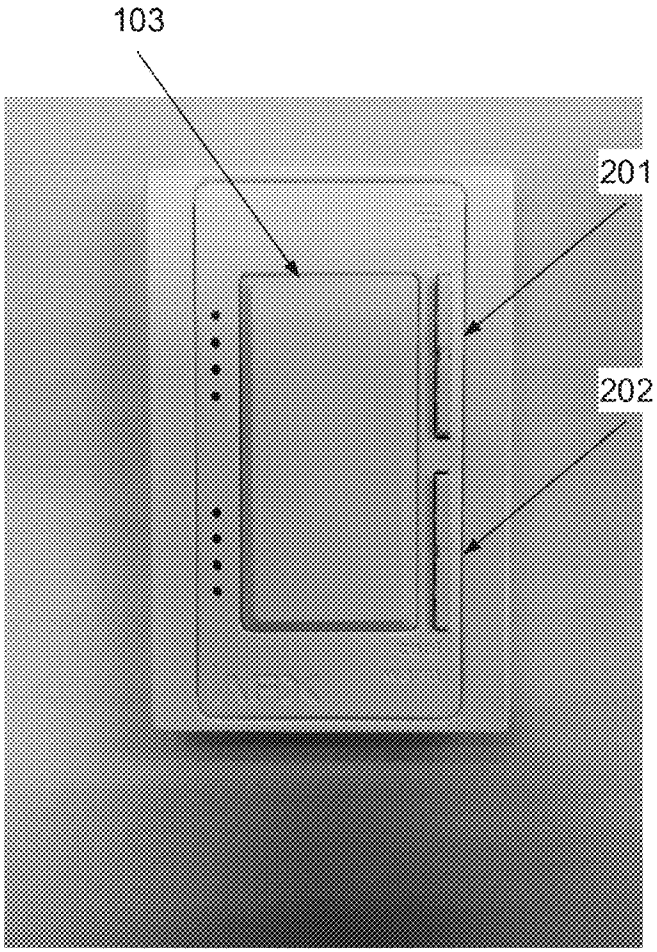
FIG. 3A is a schematic illustration of a facing of another design of the light control unit, according to some embodiments of the present invention.
Figure 3B:
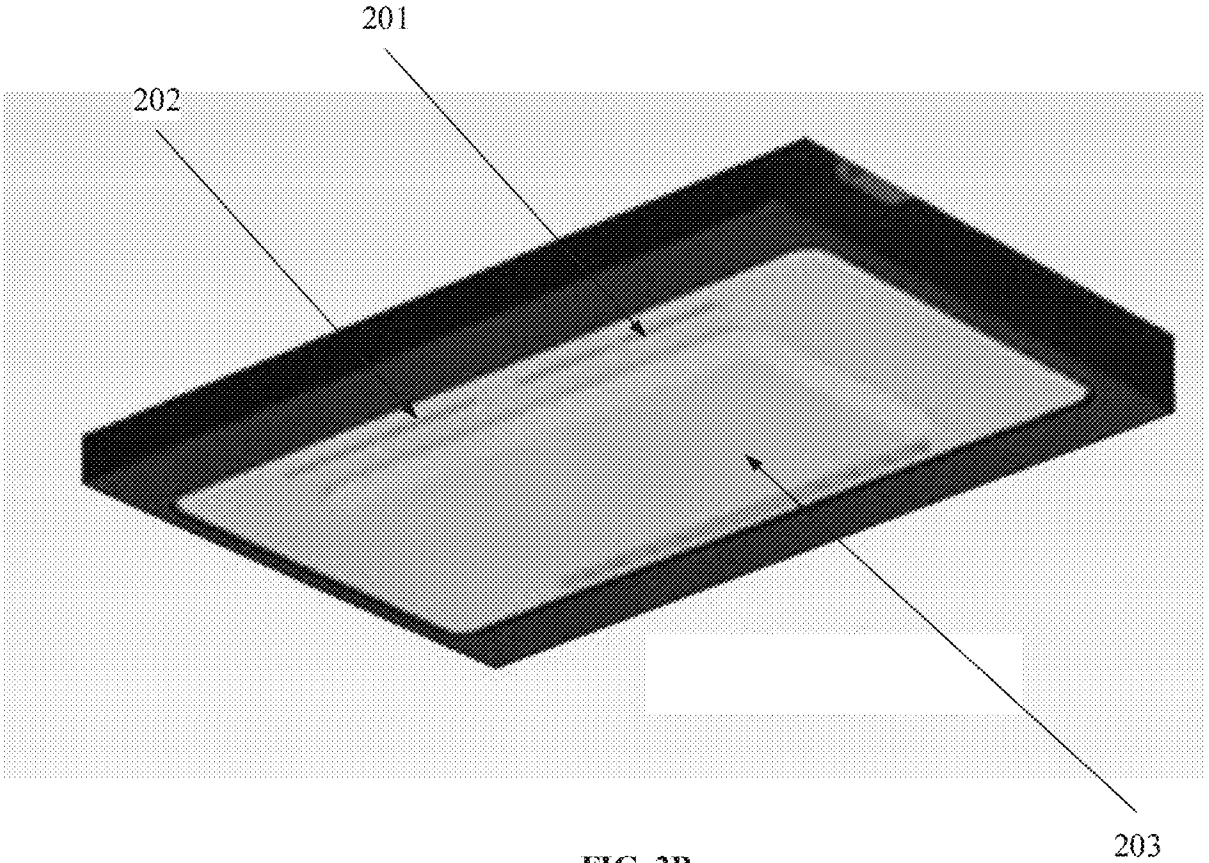
FIG. 3B is a schematic illustration of a facing of further another design of the light control unit which is adapted for under cabinet mounting, according to some embodiments of the present invention.

Optionally, as depicted in FIG. 1, the AC/DC driver 105 is external to the housing of the wall mounted light control unit 100. The color temperature control may allow a user to control color temperature changes, for instance between 2700K and 4000K, optionally along with presets at 2700K, 3000K, 3500K, and 4000K. The light dimming control may allow the user to control a full range of dimming the light emitted from the light sources which are electronically connected to the light control unit. When the AC/DC driver is external to the light control unit, multiple remote drivers may be used, allowing a number of light resources to be linked in a series to meet needs of various applications. FIG. 3A describes a facing of another design of the light control unit, according to some embodiments of the present invention. FIG. 3B describes a facing of further another design of the light control unit which is adapted for under cabinet mounting (e.g. mounted toward the floor for instance under the table), according to some embodiments of the present invention.

While in FIG. 1 slider controls are used for controlling brightness and color temperature, each of FIGS. 3A-3B depicts an on/off switch 103 and touch buttons 201, 202 for increasing and/or reducing brightness and for changing color. Other man machine controls may be used, for instance rolling knobs, different sliding knows, press buttons, keypads and/or the like.

Figure 3C:
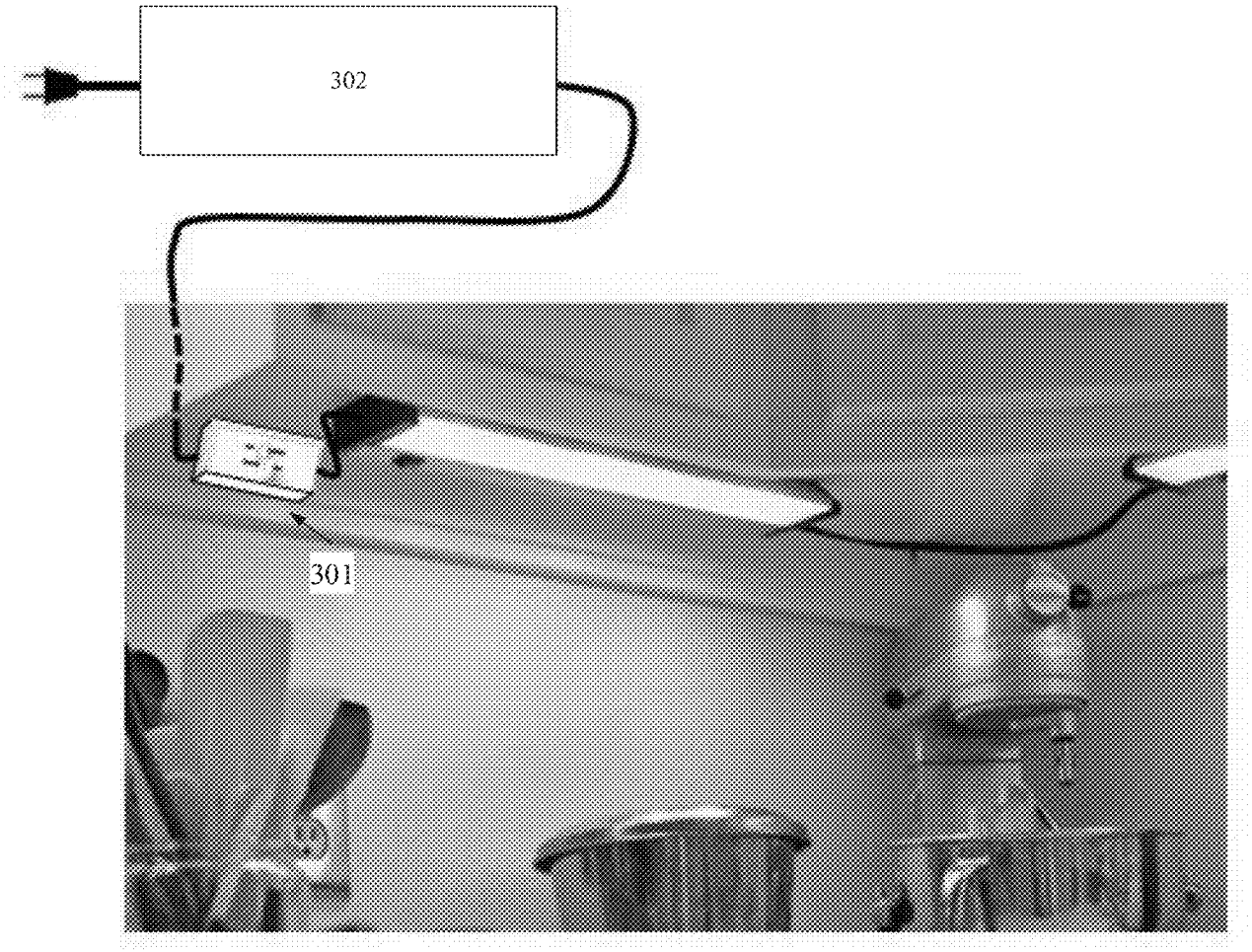
FIG. 3C is a schematic illustration of an exemplary light control unit that includes two DC dimmer switches for controlling a light source and is adapted to be electronically connected between an external driver connected to an AC source and a light source, according to some embodiments of the present invention.

Reference is also made to FIG. 3C, which is another schematic illustration of an exemplary light control unit 301 that includes two DC dimmer switches for controlling a light source and is adapted to be electronically connected between an external driver 302 connected to an AC source and a light source, according to some embodiments of the present invention. In FIG. 3C, the exemplary light control unit is connected to the imaged a series of kitchen light fixtures.

Figure 4:
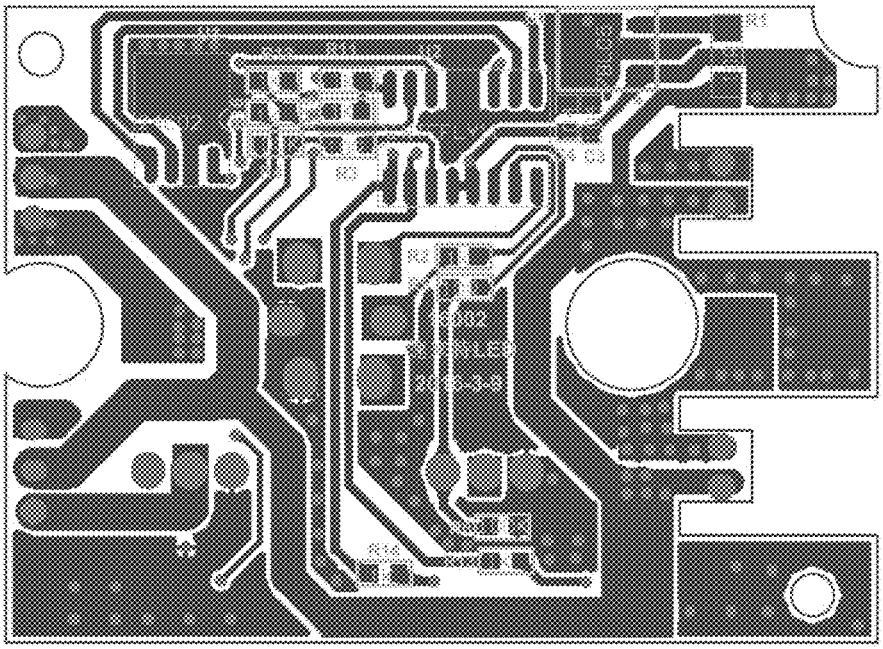
FIGS. 4 and 5 are schematic illustrations of back and front integrated circuits, according to some embodiments of the present invention.
Figure 5:
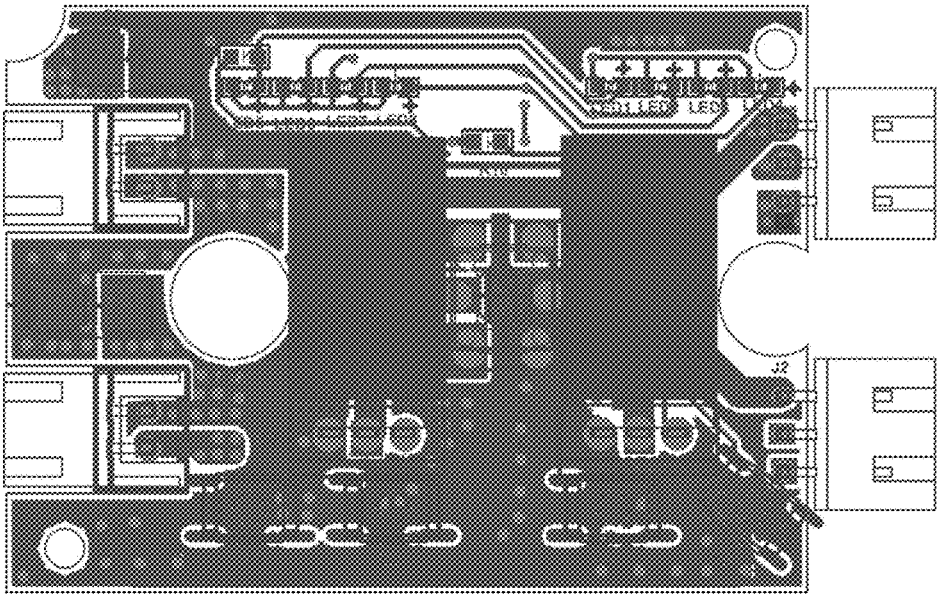
Figure 6:
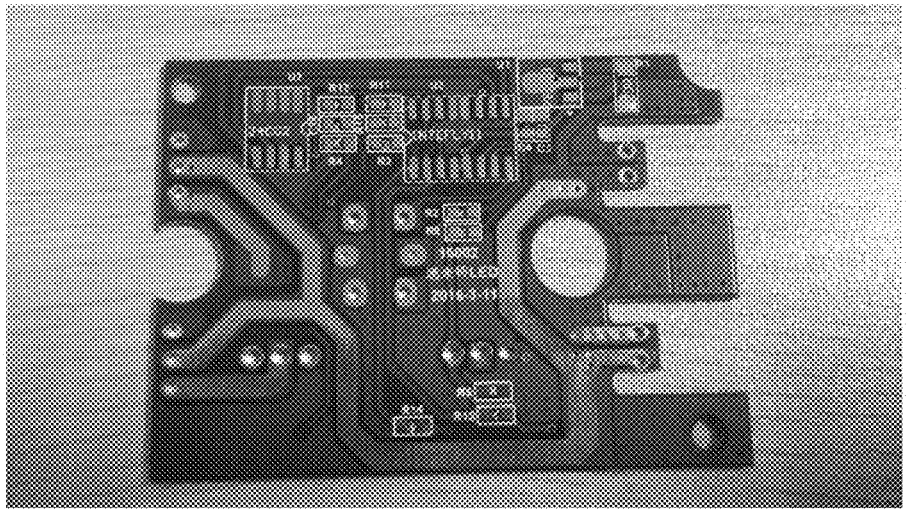
FIGS. 6 and 7 are images of back and front integrated circuits, according to some embodiments of the present invention.
Figure 7:
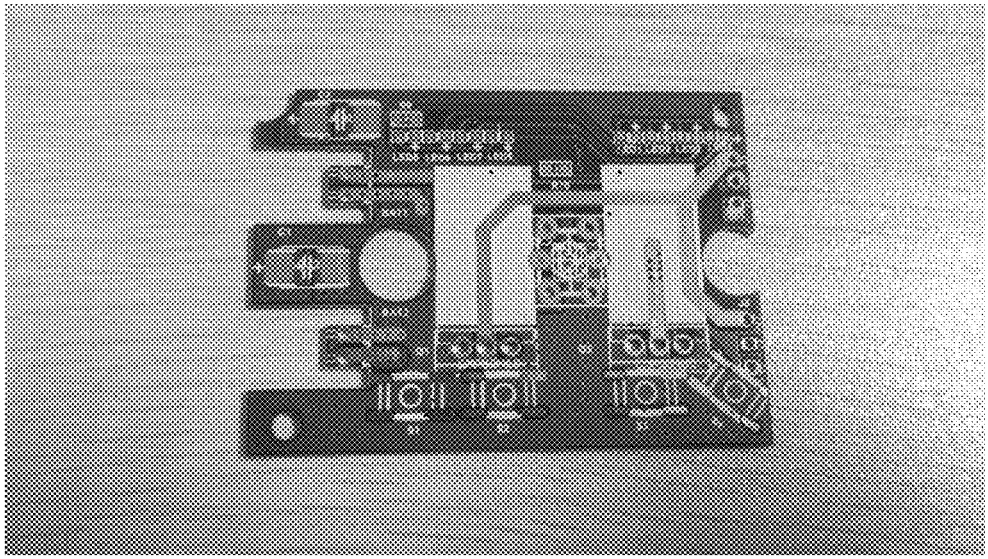
Figure 8A:
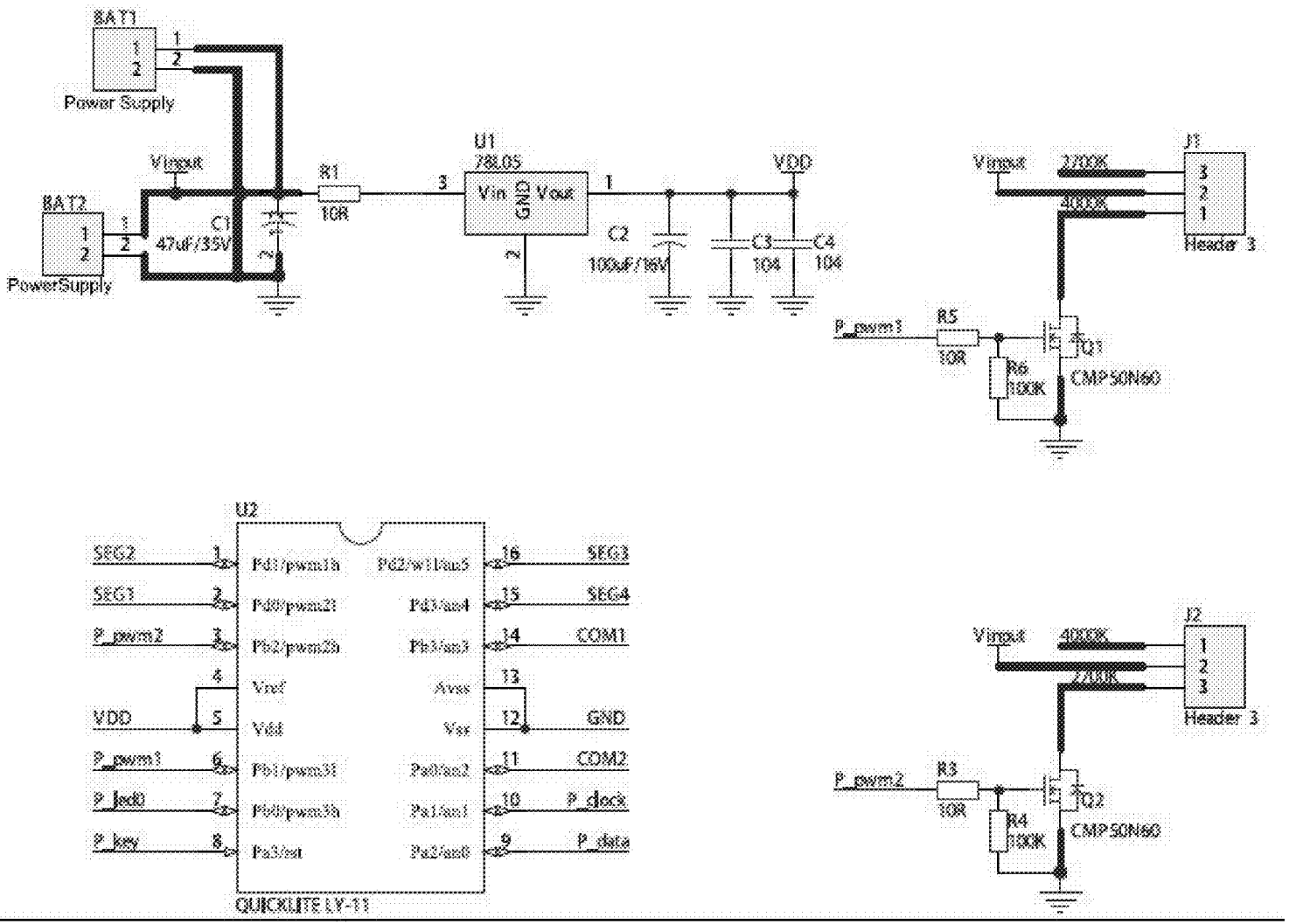
FIGS. 8A and 8B are illustrations of a design of an exemplary IC, according to some embodiments of the present invention.
Figure 8B:
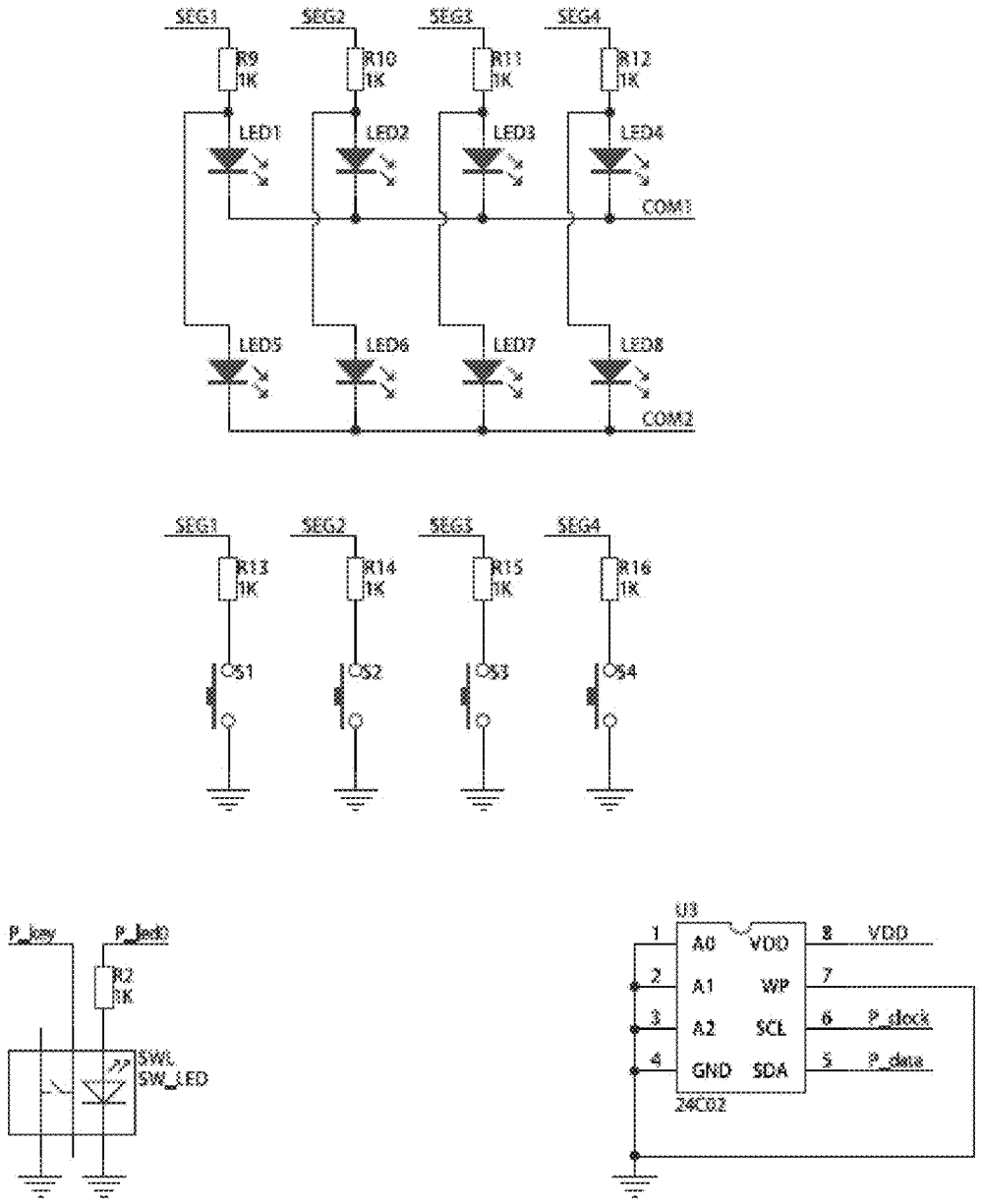

Each of FIGS. 1 and 3B-3C teaches light control unit with a light dimming control for lowering and increasing brightness of the light emitted from the light source and a color temperature control for changing the CCT of the light source. The light dimming control and the color temperature control are optionally fabricated or otherwise mounted on a common IC. For example, FIGS. 4 and 5 depict respectively a back and a front of such a common IC. See also FIGS. 6 and 7 which are respectively of an exemplary IC. An exemplary IC design is provided in FIGS. 8A and 8B.

Figure 9:
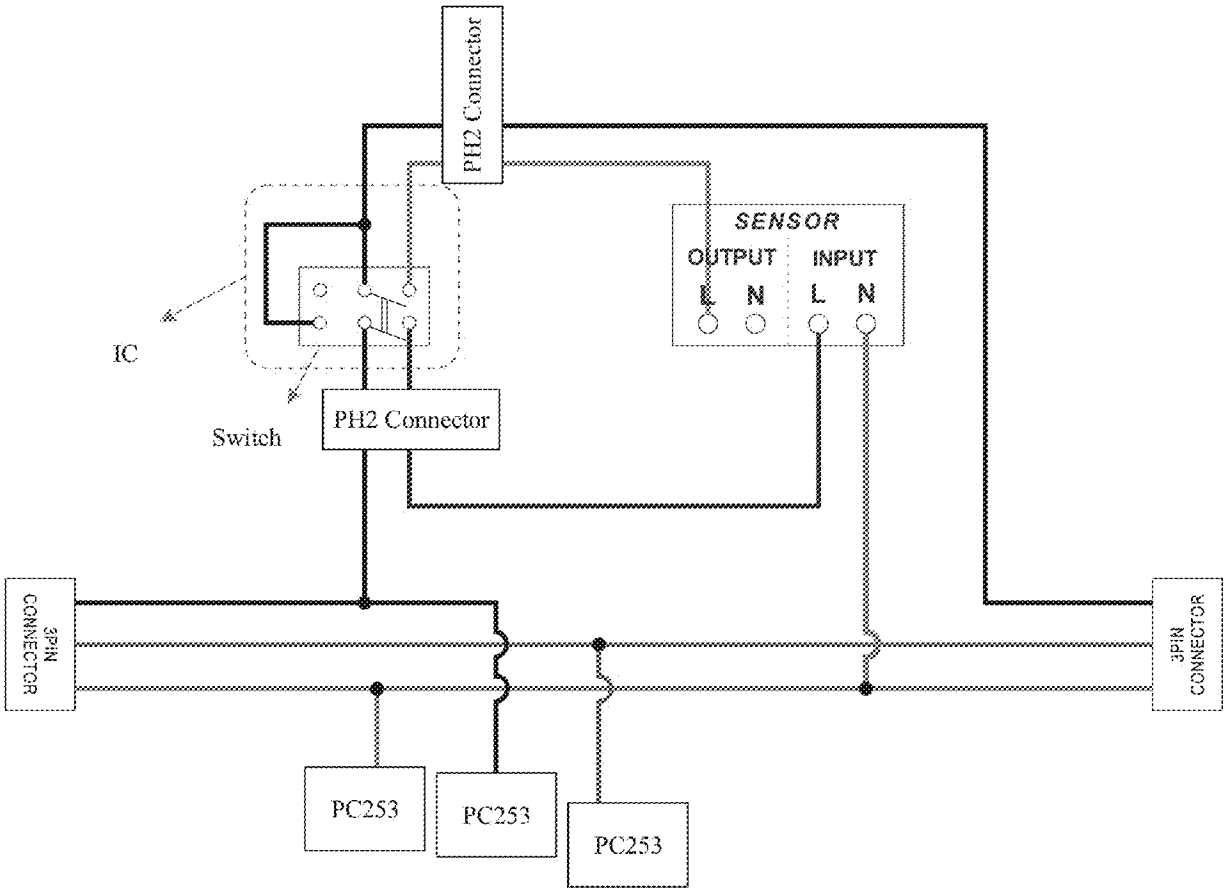
FIG. 9 is an exemplary schematic diagram of a sensor junction box with a by-pass switch design, according to some embodiments of the present invention.

Optionally, the controller is connected to a motion sensor such that a detection of motion leads to an operation of the AC power 101 switch and/or any of the two DC dimmer switches 102, 103. FIG. 9 is an exemplary schematic diagram of a sensor junction box with a by-pass switch design, according to some embodiments of the present invention.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant modules and systems will be developed and the scope of the term a module, an IC and a controller is intended to include all such new technologies a priori.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

What is claimed is:

1. A light control unit, comprising:

a housing sized and shaped as a standard electrical Handy Box; and at least one integrated circuit comprising:

a brightness dimming control adapted to change brightness of an array of a plurality of light sources and electronically connected to said at least one integrated circuit;

a correlated color temperature (CCT) control adapted to change color temperature of light emitted from said array of a plurality of light sources; and wherein said array of a plurality of light sources having different correlated color temperature (CCT) lines composed of one CCT line and of another CCT line positioned interchangeably along an axis and angled longitudinally along said axis.

2. The light control unit of claim 1, wherein said array of a plurality of light sources is linked in series.

3. The light control unit of claim 1, wherein said at least one integrated circuit further comprises a power switch.

4. The light control unit of claim 1, wherein said at least one integrated circuit is a single board IC.

5. The light control unit of claim 1, wherein said at least one integrated circuit is electronically connected to said array of a plurality of light sources via an alternating current (AC)/direct current (DC) driver.

6. The light control unit of claim 1, wherein said at least one integrated circuit is electronically connected to a power source via an alternating current (AC)/direct current (DC) driver.

7. The light control unit of claim 1, wherein said array of a plurality of light sources is an array of a plurality of light emitting diodes (LEDs) with different CCT lines.

8. The light control unit of claim 7, wherein at least one of said brightness dimming control and said correlated color temperature (CCT) control is controlled by an output of a motion sensor.

9. The light control unit of claim 1, wherein said array of a plurality of light sources having one CCT line and another CCT line angled longitudinally along said axis at about 40 degree angle.

* * * * *